US009590361B2

(12) United States Patent
Fan et al.

(10) Patent No.: US 9,590,361 B2
(45) Date of Patent: Mar. 7, 2017

(54) CABLE CONNECTOR ASSEMBLY WITH IMPROVED GROUNDING TRANSFER STRUCTURE

(71) Applicant: FOXCONN INTERCONNECT TECHNOLOGY LIMITED, Grand Cayman (KY)

(72) Inventors: Xiao Fan, Kunshan (CN); Jun Chen, Kunshan (CN); Jerry Wu, Irvine, CA (US)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/207,438

(22) Filed: Jul. 11, 2016

(65) Prior Publication Data

US 2017/0012395 A1 Jan. 12, 2017

(30) Foreign Application Priority Data

Jul. 10, 2015 (CN) ..... 2015 2 0495757

(51) Int. Cl.

| | |
|---|---|
| ***H01R 9/05*** | (2006.01) |
| ***H01R 13/6581*** | (2011.01) |
| ***H01R 24/62*** | (2011.01) |
| ***H01R 13/436*** | (2006.01) |
| *H01R 107/00* | (2006.01) |
| *H01R 12/77* | (2011.01) |
| *H01R 13/6593* | (2011.01) |

(52) U.S. Cl.

CPC ..... *H01R 13/6581* (2013.01); *H01R 9/0512* (2013.01); *H01R 13/436* (2013.01); *H01R 24/62* (2013.01); *H01R 12/775* (2013.01); *H01R 13/6593* (2013.01); *H01R 2107/00* (2013.01)

(58) Field of Classification Search

None

See application file for complete search history.

(56) References Cited

U.S. PATENT DOCUMENTS

| | | | | |
|---|---|---|---|---|
| 7,534,143 | B1 * | 5/2009 | Tsao | H01R 13/58 439/497 |
| 8,500,494 | B2 * | 8/2013 | Wu | H01R 13/6461 439/660 |
| 8,591,259 | B2 | 11/2013 | Wu | |
| 2013/0130546 | A1 * | 5/2013 | Wu | H01R 13/40 439/604 |

* cited by examiner

*Primary Examiner* — Tho D Ta

(74) *Attorney, Agent, or Firm* — Wei Te Chung; Ming Chieh Chang

(57) ABSTRACT

A cable connector assembly comprises an insulative housing, a plurality of contacts retained in the insulative housing and including a grounding contact, a cable and a connecting member, each of the contacts defines a soldering portion, the soldering portions are arranged in two rows spaced along a vertical direction, each row of the soldering portions includes one part of the grounding soldering portion, the cable includes a plurality of coaxial wires to electrically connect with corresponding contacts, each coaxial wire includes an inner conductor, a inner insulative layer enclosing the inner conductor, a braiding layer enclosing the insulative layer, and an outer insulative layer enclosing the braiding layer, the connecting member is electrically connected with the parts of the grounding soldering portion and the braiding layers of the coaxial wires.

13 Claims, 9 Drawing Sheets

CABLE CONNECTOR ASSEMBLY WITH IMPROVED GROUNDING TRANSFER STRUCTURE

BACKGROUND OF THE INVENTION

1. Field of the Invention

The present invention relates to a cable connector assembly, and more particularly to a cable connector assembly having improved grounding transfer structure.

2. Description of Related Art

U.S. Pat. No. 8,591,259, issued on Nov. 26, 2013, discloses a cable connector assembly. The cable connector assembly includes an insulative housing, a plurality of contacts retained in the insulative housing, a metal shell enclosing the insulative housing, a pair of latches fixed in the insulative housing and exposed to the metal shell, a spacer mounted on a rear end of the insulative housing to fit rear ends of the contacts, and a cable connected with the contacts. The cable includes a plurality of twisted pairs for transmitting high-speed signal and a plurality of single lines.

BRIEF SUMMARY OF THE INVENTION

According to one aspect of the present invention, a cable connector assembly comprises: A cable connector assembly comprising: an insulative housing, a plurality of contacts retained in the insulative housing and including a grounding contact, a cable and a connecting member, each of the contacts defines a soldering portion, the soldering portions are arranged in two rows spaced along a vertical direction, each row of the soldering portions includes one part of the grounding soldering portion, the cable includes a plurality of coaxial wires to electrically connect with corresponding contacts, each coaxial wire includes an inner conductor, a inner insulative layer enclosing the inner conductor, a braiding layer enclosing the insulative layer, and an outer insulative layer enclosing the braiding layer, the connecting member is electrically connected with the parts of the grounding soldering portion and the braiding layers of the coaxial wires.

BRIEF DESCRIPTION OF THE DRAWINGS

For a more complete understanding of the present invention, and the advantages thereof, reference is now made to the following descriptions taken in conjunction with the accompanying drawings, in which:

FIG. 7 is a partly exploded view of the contacts of the cable connector assembly shown in FIG. 1 to show the grounding bar adapted to be positioned upon the projecting portion; and.

DETAILED DESCRIPTION OF THE PREFERRED EMBODIMENT

Figure 1:
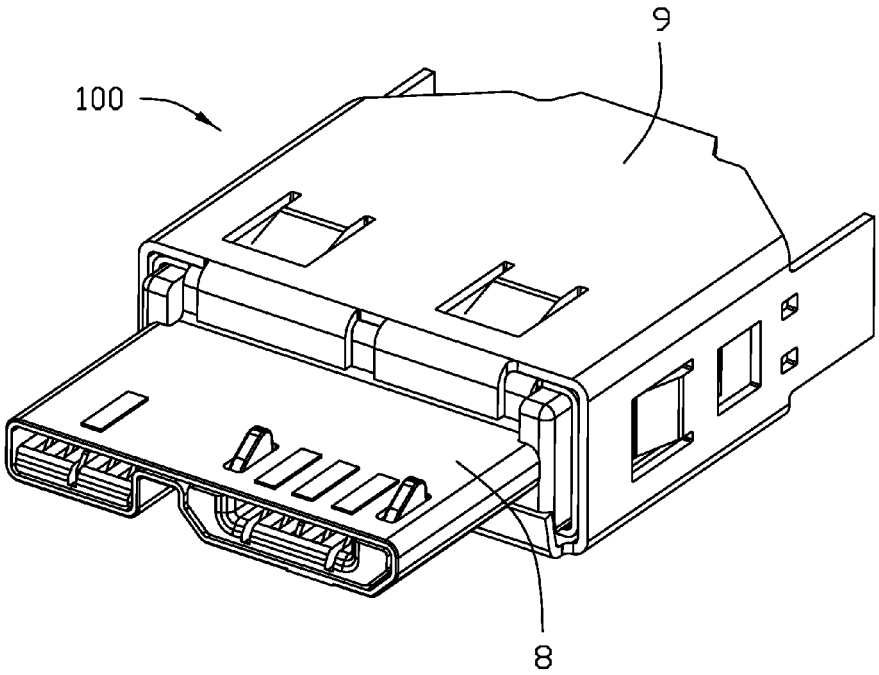
FIG. 1 is a perspective assembled view of a cable connector assembly according to the present invention.
Figure 2:
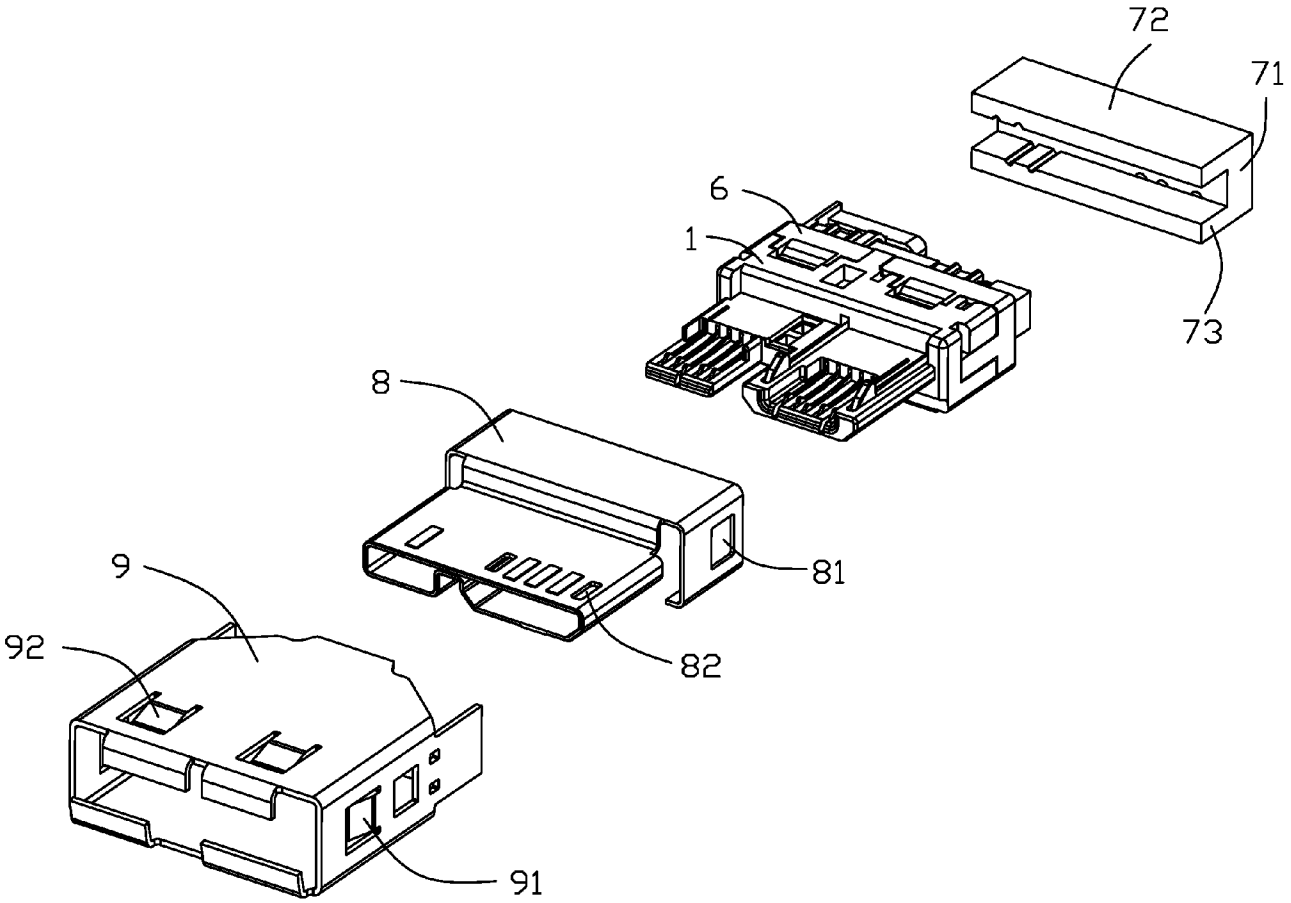
FIG. 2 is a partly exploded view of the cable connector assembly shown in FIG. 1.
Figure 3:
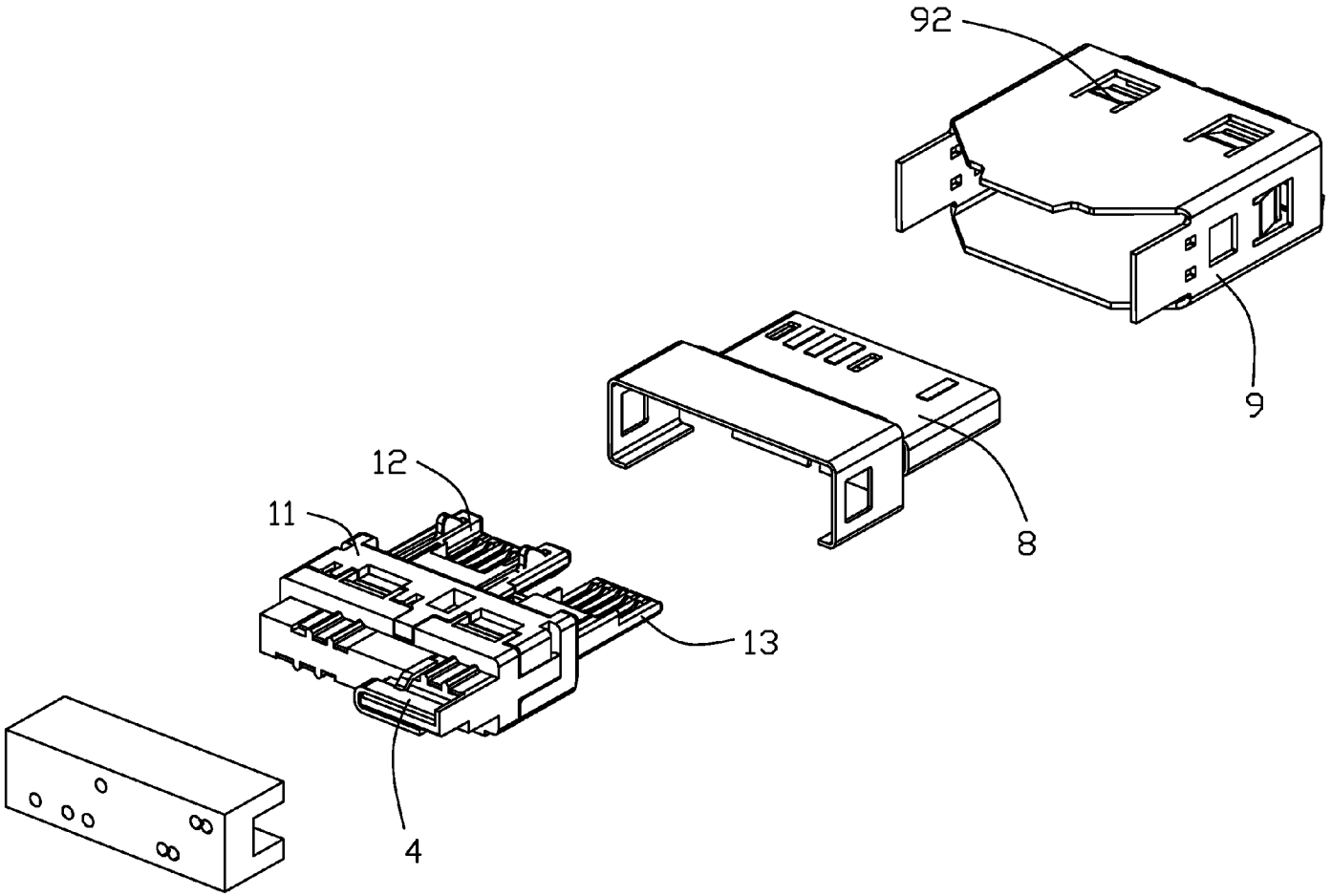
FIG. 3 is a partly exploded view similar to FIG. 3, but from a different perspective.
Figure 4:
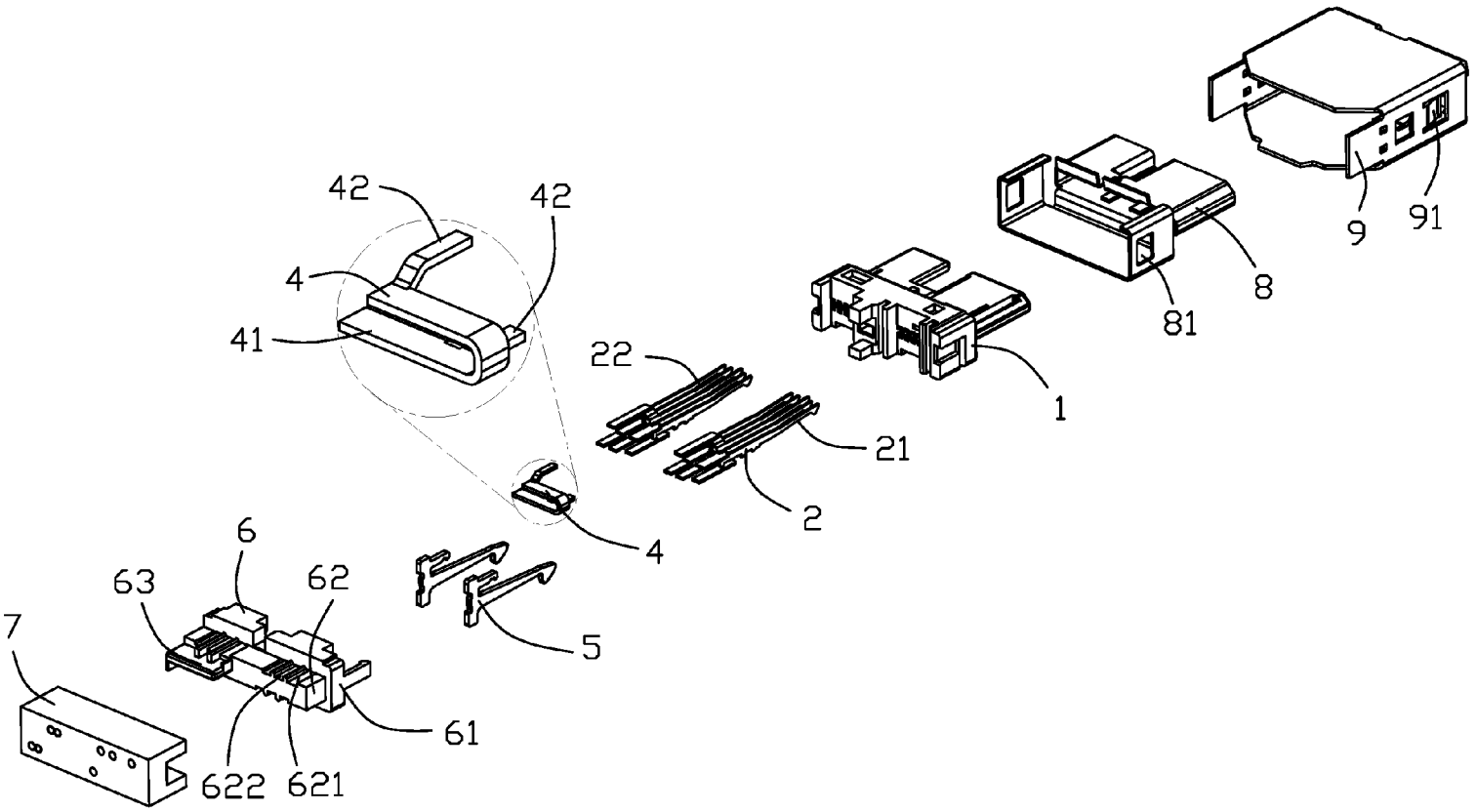
FIG. 4 is an exploded view of the cable connector assembly shown in FIG. 3.
Figure 5:
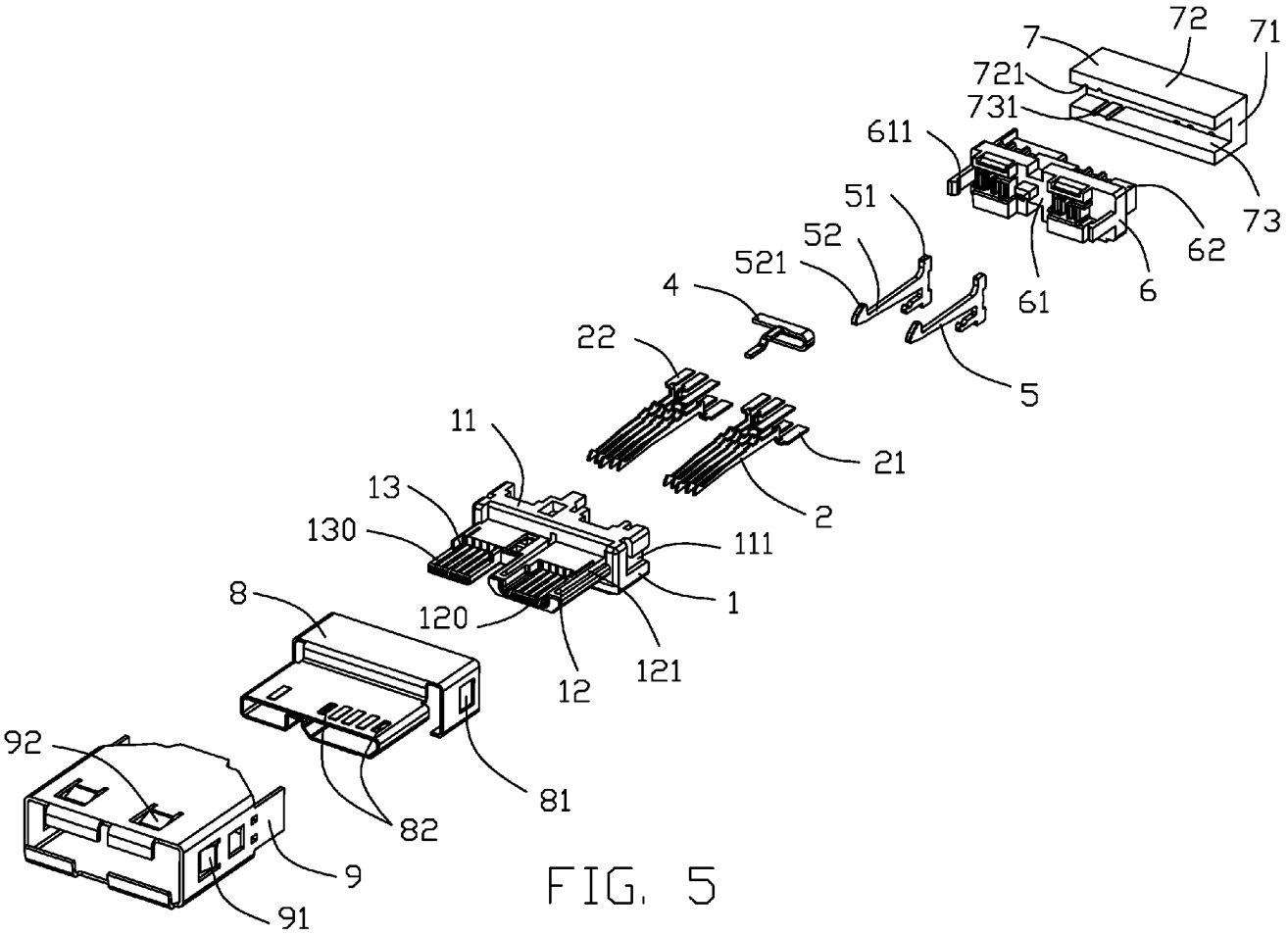
FIG. 5 is an exploded view similar to FIG. 4, but from a different perspective.

Referring to FIGS. 1-5, a cable connector assembly 100 according to a preferred embodiment of the present invention is used to electrically connect with a mating connector. The cable connector assembly 100 according to a preferred embodiment is a MICRO B connector assembly. The cable connector assembly 100 includes an insulative housing 1, a plurality of contacts 2 retained in the insulative housing 1 and each extending along a front-to-back direction, a cable electrically connected with the contacts 2, a connecting member or grounding bar 4 positioned on a rear end of the contacts 2, a pair of latches 5 fixed in the insulative housing 1 and spaced from each other in a transverse direction perpendicular to the front-to-back direction for engaging with the mating connector, a fixing member 6 disposed an a rear end of the contacts 2, a spacer 7 for fixing cable 3, a mating case 8 enclosing the insulative housing 1 and a metal case 9 enclosing the fixing member 6 and the spacer 7. In this embodiment, an insulating case (not shown) may also be provided outside the metal case 9.

The insulative housing 1 includes a base portion 11, a first tongue portion 12 and a second tongue portion 13. Both of the first and second tongue portions 12, 13 are forwardly extended from the base portion 11. The first tongue portion 12 and the second tongue portion 13 are disposed on a same horizontal plane. The width of the second tongue portion 13 is greater than the width of the first tongue portion 12 along a horizontal plane. The dimension of the first tongue portion 12 is consistent with USB 2.0 plug electrical connector standard. The dimension of the second tongue portion 13 is consistent with USB 3.0 plug electrical connector standard. The first tongue portion 12 defines a plurality of first receiving slots 120 on an upper sidewall thereof. The second tongue portion 13 defines a plurality of second receiving slots 130 on an upper sidewall thereof. The first tongue portion 12 defines a mounting slot 121 for receiving the corresponding latch 5 on both sides thereof respectively. The first tongue portion 12 is of a concave shape. The second tongue portion 13 is of a plate-shaped. The base portion 11 respectively defines a recessing portion 111 on both sides thereof.

Figure 6:
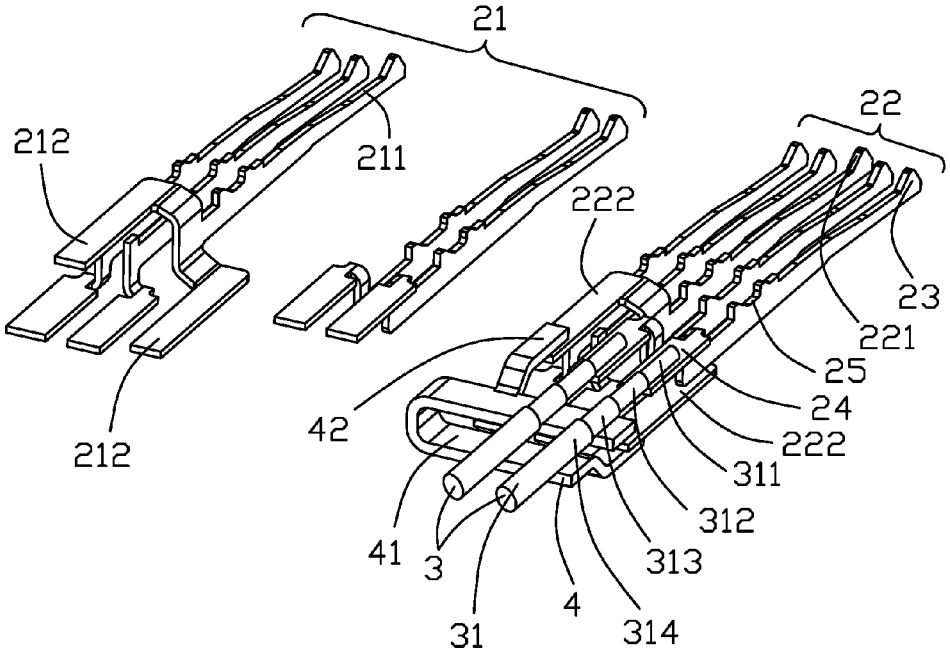
FIG. 6 is a partly exploded view of the contacts of the cable connector assembly shown in FIG. 1.
Figure 7:
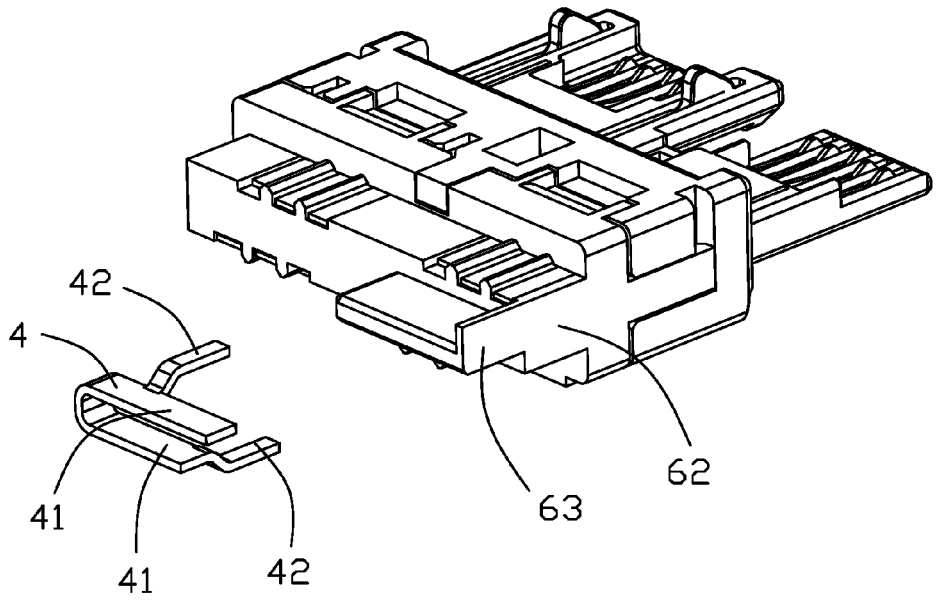
Figure 8A:
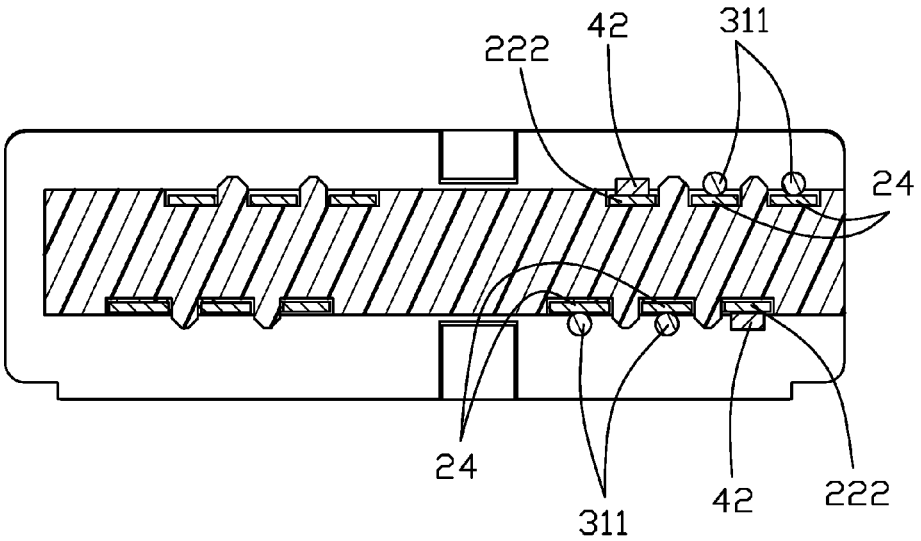
FIG. 8(A) is a rear view of the cable connector assembly of FIG. 1 to show the connection between the inner conductors and the soldering portions of the signal contacts and that between the extension portion of the grounding bar and the grounding soldering portion.
Figure 8B:
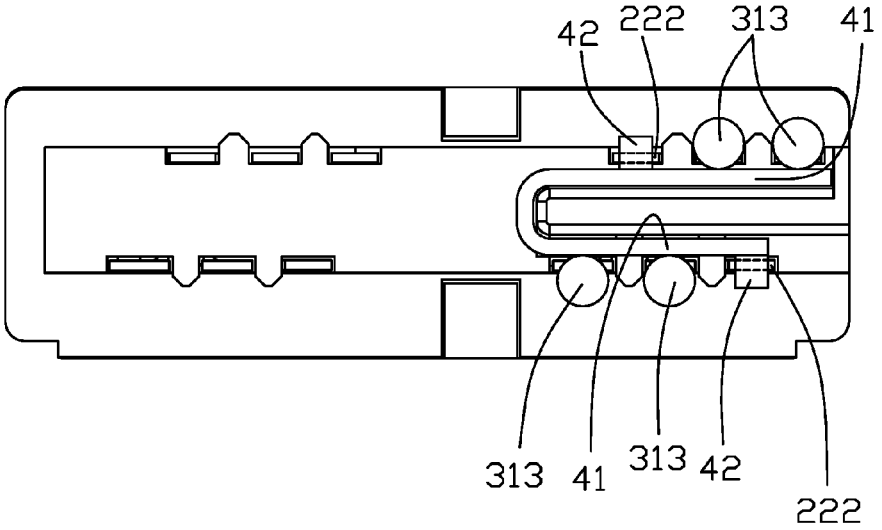
FIG. 8(B) is a rear view of the cable connector assembly to show the connection between the braiding layers and the main body of the grounding bar.

Referring to FIG. 6, the contacts 2 includes a first set of contacts 21 received in the first tongue portion 12 and a second set of contacts 22 received in the second tongue portion 13. The first set of contacts 21 is of similar structure to the second set of contacts 22. Each of the contacts 2 includes a contacting portion 23 electrically contacted with the mating connector, a soldering portion 24 soldered with the cable 3, and a fixing portion 25 fixed in the insulative housing 1 and connecting between the contacting portion 23 and the soldering portion 24. The first set of contacts 21 includes five contacts, for transmitting the USB 2.0 protocol. The first set of contacts 21 includes a power contacts, a grounding contact, an identification contact and positive and negative signal contacts 211. The second set of contacts 22 includes five contacts, for transmitting the USB 3.0 protocol. The second set of contacts 22 includes two (differential) pair of high-speed signal contacts by two sides of a grounding contact 221. The soldering portions 24 of the first and second set of contacts 21, 22 are arranged in two rows spaced with each other along a vertical direction perpendicular to both the front-to-back direction and the transverse direction. Each row is spanned in the transverse direction. The contacting portion 23 and the fixing portion 25 of the contacts 2 is disposed in a plane perpendicular to a plane the soldering portion 24 disposed on. Two signal soldering portion 212 are rearwardly extending from the fixing portion 25 of the center, positive signal contact 211 of the first set of contacts 21. Two grounding soldering portion 222 are rearwardly extending from the fixing portion 25 of the center grounding contact 221 of the second set of contacts 22. In this embodiment, in the second set of contacts 22, the soldering portions 24 of the two pairs of high speed signal contacts are located by two sides of the grounding soldering portion 222 of the grounding contact 221.

The cable 3 includes a plurality of (differential) coaxial wires 31. The coaxial wire 31 includes an inner conductor 311, an inner insulative layer 312 enclosing the inner conductor 311, a braiding layer 313 enclosing the insulative layer 312 and an outer insulative layer 314 enclosing the braiding layer 313. The coaxial wires 31 are soldered with the (differential) high-speed signal contacts of the second set of contacts 22.

The connecting member 4 is electrically soldered with the grounding soldering portion 222 of the two rows of soldering portion 24. The braiding layer 313 of the coaxial wires 31 is soldered with the connecting member 4. The connecting member 4 includes a main body 41 being of U-shape in a plane along a horizontal direction, and an extension portion 42 rearwardly extending from each side of the main body 41. The extension portions 42 are soldered with the corresponding grounding soldering portion 222 for electrical connecting. The soldering portion 24 of the pair high-speed signals located on the upper row are soldered with two coaxial wires 31, the braiding layer 313 of the two coaxial wires 31 are soldered with a upper portion of the main body 41. The soldering portion 24 of the pair high-speed signals located on the lower row are soldered with another two coaxial wires 31, the braiding layer 313 of the two coaxial wires 31 are soldered with a lower portion of the main body 41.

Each of latches 5 includes a retain arm 51 retaining in the base portion 11 of the insulating housing 1, a latch arm 52 forwardly extending from the retain arm 51 and received in the corresponding mounting slot 121 of the insulative housing 1. A front end of the latch arm 52 extents to from a upwardly projecting locking portion 521.

The fixing member 6 includes a mounting portion 61, a holding portion 62 disposed behind the mounting portion 61 and a projecting portion 63 rearwardly extending from the holding portion 62. The main body 41 of the connecting portion 4 is bent to match the shape of the projecting portion 63, for being mounted on the projecting portion 63. The both sides of the mounting portion 61 of the fixing member 6 extend to form a snap arm 611. The snap arm 611 is snap-fit with the recessing portion 111 of the base portion 11. The holding portion 62 of the fixing member 6 defines a plurality of railing portion 621. A receiving groove 622 is formed between the adjacent railing portions 621 to receive the soldering portion 24 of the contacts 2. Notably, in this embodiment, the fixing member is to provide means for supporting/regulating the soldering portions 24 for facilitating soldering with the inner conductors 311. Anyhow, the fixing member 6 may be integrally formed with the housing 1, alternately.

The spacer 7 includes a sidewall 71 along a vertical plane, upper sidewall 72 extending from a upper end of the sidewall 71 and a lower sidewall 73 extending from a bottom end of the sidewall 71. The upper sidewall 72 and the lower sidewall 73 hold the holding portion 62 of the fixing member 6. The cable 3 extends rearwardly out from the sidewall 71. The upper sidewall 72 defines a plurality of holding slots 721. The lower sidewall 73 defines a plurality of holding slots 731. Each of the holding slots 721, 731 hold a top portion of the corresponding railing portion 621.

The mating case 8 is mounted on the insulative housing 1 along a front-to-rear direction to enclose the insulative housing 1. The mating case 8 define an opening 81 on each side thereof and a pair of through holes 82 on a top surface. The locking portions 521 of the latches 5 expose to the mating case 8 through the through holes 82, to lock with the mating connector.

The metal case 9 is a frame-shaped. The metal case 9 includes first resilient sheets 91 defined on side surfaces thereof and second resilient sheets 92 defined on a top surface thereof. The first resilient sheets 91 are engaged and fixed with the opening 81 of the mating case 8. The second resilient sheets 92 are engaged with the fixing member 6 and fixed on the fixing member 6.

One feature of the invention is to provide two level of the grounding bar 4 with the main body 41 being located at the first level and the extension portion 42 being located at the second level wherein the first level is closer to the mid-level of both the holding portion 52 and the projecting portion 63 than the second level to the mid-level, thus allowing not only the extension 42 to be soldered upon the corresponding grounding soldering portion 222 and the inner conductors 311 soldered upon the corresponding soldering portions 24 of the (differential) high-speed signal contacts 22 by two sides of the grounding contact 221 compliantly, but also the main portion 41 soldered with the braiding layer 313 compliantly. In other words, the offset arrangement between the extension portion 42 and the main body 41 in the vertical direction may comply with the height difference derived from the diameter difference between the inner conductor 311 and the braiding layer 313 of each wire 31. Furthermore, in this embodiment because the soldering portions 24 are arranged in two rows at two different floors/levels and the wires 31 are also arranged at two floors/levels correspondingly, the grounding bar 4 is also formed with a lying U-shaped configuration to include two corresponding arms for complying with those two floors/levels. In this embodiment, to comply with the two-leveled soldering portions 24 of the two differential pairs of high speed signal contacts 22 by two sides of the grounding contact 221, the grounding soldering portion 222 of the grounding contact 221 forms two parts at each level and the extension portion 42 is formed with two parts at two different levels correspondingly also. Anyhow, in an alternate embodiment, a single grounding soldering portion 42 is implemented.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A cable connector assembly comprising:

an insulative housing;

a plurality of contacts retained in the insulative housing and including a grounding contact, each of the contacts defining a soldering portion, the soldering portions arranged in two rows spaced along a vertical direction, each row of the soldering portions including one part of the grounding soldering portion;

a cable including a plurality of coaxial wires to electrically connect with corresponding contacts, each coaxial wire including an inner conductor, an inner insulative layer enclosing the inner conductor, a braiding layer enclosing the insulative layer, and an outer insulative layer enclosing the braiding layer;

a connecting member electrically connected with the parts of the grounding soldering portion and the braiding layers of the coaxial wires;

wherein the grounding contact defines a pair of grounding soldering portion, and one of the grounding soldering portions is disposed in the upper row of soldering portions, the another of the grounding soldering portions is disposed in the lower row of soldering portions;

wherein the connecting member includes a u-shaped main body extending along a horizontal direction and an extension portion forwardly extending from each side of the main body to be electrically connected with the corresponding grounding soldering portion of the grounding contact;

a fixing member, the fixing member includes a holding portion and a projecting portion rearwardly extending from the holding portion for mounting the main body of the connecting member thereon; and a spacer, the spacer includes a sidewall along a vertical plane, an upper sidewall forwardly extending from an upper end of the sidewall and a lower sidewall forwardly extending from a bottom end of the sidewall, the projecting portion of the fixing member is held between the upper sidewall and the lower sidewall.

2. The cable connector assembly according to the claim 1, wherein the extension portion is electrically connected with the grounding soldering portion by welding way.

3. The cable connector assembly according to the claim 1, wherein the holding portion of the fixing member defines a plurality of railing portion, and a receiving groove formed between the adjacent railing portions to receive the soldering portion of the contacts.

4. The cable connector assembly according to claim 1, wherein both of the upper and lower sidewall define a plurality of holding slots for holding a top portion of the corresponding railing portion.

5. A cable connector assembly comprising: an insulative housing;

a plurality of contacts disposed in the housing and side by side arranged with one another along a transverse direction while each of said contacts extending along a front-to-back direction perpendicular to said transverse direction, said contacting being categorized with two differential pairs of high speed signal contacts by two sides of a grounding contact in said transverse direction, each of said contacts including a front contacting portion and a rear soldering portion along the front-to-back direction wherein the grounding contacts forms two rear soldering portions, the front contacting portions being arranged in one front row along the transverse direction while the soldering portion being arranged in two rear rows each spanning in said transverse direction while said two rear rows being spaced from each other in a vertical direction perpendicular to the front-to-back direction, in each rear row said soldering portions including two soldering portions of one pair of high speed signal contacts and one soldering portion of the grounding contact;

a metallic grounding bar including a main body and an extension portion forwardly extending from the main body and located at a different level with regard to the main body in the vertical direction;

a cable including a plurality of differential coaxial wires each including an inner conductor, an inner insulative layer, a braiding layer and an outer insulative layer sequentially circumferentially surrounding one another; wherein the extension portion is soldered upon the grounding soldering portion of the grounding contact while the inner conductors are soldered upon the soldering portions of the corresponding high speed signal contacts, and the braiding layer is soldered upon the main body, respectively;

a fixing member on a rear side of the housing for regulating the soldering portions of the contacts, the fixing member includes a holding portion and a projecting portion rearwardly extending from the holding portion for mounting the main body of the metallic grounding bar thereon; and a spacer, the spacer includes a sidewall along a vertical plane, an upper sidewall forwardly extending from an upper end of the sidewall and a lower sidewall forwardly extending from a bottom end of the sidewall, the projecting portion of the fixing member is held between the upper sidewall and the lower sidewall.

6. The cable connector assembly as claimed in claim 5, wherein said grounding bar includes two arms spaced from each other in the vertical direction to comply with the two rear rows of the rear soldering portions of the contacts, respectively.

7. The cable connector assembly as claimed in claim 6, wherein said grounding bar forms a U-shaped configuration with said two arms thereon.

8. The cable connector assembly as claimed in claim 6, wherein said grounding bar includes two said extension portions respectively soldered upon the corresponding grounding soldering portions in two different rear rows, respectively.

9. The cable connector assembly as claimed in claim 6, wherein the wires are arranged in two rows spaced from each other in the vertical direction to comply with the two rear rows of the soldering portions of said contacts in the vertical direction.

10. A cable connector assembly comprising:

an insulative housing;

a plurality of contacts disposed in the housing and side by side arranged with one another along a transverse direction while each of said contacts extending along a front-to-back direction perpendicular to said transverse direction, said contacting being categorized with two differential pairs of high speed signal contacts by two sides of a grounding contact in said transverse direction, each of said contacts including a front contacting portion and a rear soldering portion along the front-to-back direction, the front contacting portions being arranged in one front row along the transverse direction while the soldering portion being arranged in two rear rows each spanning in said transverse direction while said two rear rows being spaced from each other in a vertical direction perpendicular to the front-to-back direction, in each row said soldering portions including at least two soldering portions of one pair of high speed signal contacts wherein one of said two rear rows further includes one soldering portion of the grounding contact;

a metallic grounding bar including a main body and an extension portion forwardly extending from the main body and located at a different level with regard to the main body in the vertical direction;

a cable including a plurality of differential coaxial wires each including an inner conductor, an inner insulative layer, a braiding layer and an outer insulative layer sequentially circumferentially surrounding one another; wherein the extension portion is soldered upon the grounding soldering portion of the grounding contact while the inner conductors are soldered upon the soldering portions of the corresponding high speed signal contacts, and the braiding layer is soldered upon the main body, respectively;

a fixing member on a rear side of the housing for regulating the soldering portions of the contacts, the fixing member includes a holding portion and a projecting portion rearwardly extending from the holding portion for mounting the main body of the metallic grounding bar thereon; and a spacer, the spacer includes a sidewall along a vertical plane, an upper sidewall forwardly extending from an upper end of the sidewall and a lower sidewall forwardly extending from a bottom end of the sidewall, the projecting portion of the fixing member is held between the upper sidewall and the lower sidewall.

11. The cable connector assembly as claimed in claim 10, wherein said fixing member is discrete from the housing.

12. The cable connector assembly as claimed in claim 10, wherein said grounding bar includes two arms spaced from each other in the vertical direction to comply with the two rear rows of the rear soldering portions of the contacts, respectively.

13. The cable connector assembly as claimed in claim 12, wherein said grounding bar forms a U-shaped configuration with said two arms thereon.

* * * * *